US006778283B2

(12) United States Patent
Lee et al.

(10) Patent No.: US 6,778,283 B2
(45) Date of Patent: Aug. 17, 2004

(54) METHOD AND APPARATUS FOR LOCATING A FOOTBALL ON A FIELD OF PLAY

(75) Inventors: Jeff L. Lee, Louisville, KY (US); John F. Naber, Prospect, KY (US)

(73) Assignee: 4th & Exactly LLC, Louisville, KY (US)

( * ) Notice: Subject to any disclaimer, the term of this patent is extended or adjusted under 35 U.S.C. 154(b) by 132 days.

(21) Appl. No.: 10/040,796

(22) Filed: Jan. 7, 2002

(65) Prior Publication Data

US 2002/0089674 A1 Jul. 11, 2002

Related U.S. Application Data

(60) Provisional application No. 60/259,688, filed on Jan. 5, 2001.

(51) Int. Cl.[7] ..... G01B 11/14; G01C 15/00

(52) U.S. Cl. ..... 356/614; 356/615; 356/620; 33/289

(58) Field of Search ..... 356/614, 615, 356/620; 33/289

(56) References Cited

U.S. PATENT DOCUMENTS 3,985,356 A 10/1976 Carlock
4,090,708 A 5/1978 McPeak
5,051,934 A * 9/1991 Wiklund ..... 356/152.3
5,214,491 A 5/1993 Snowden
5,477,459 A * 12/1995 Clegg et al. ..... 701/300

OTHER PUBLICATIONS

Leica Geosystems AG, The Leica TPS 1100 at a Glance. 1999, Switzerland.

* cited by examiner

*Primary Examiner*—Frank G. Font
*Assistant Examiner*—Roy M. Punnoose
(74) *Attorney, Agent, or Firm*—Greenebaum Doll & McDonald PLLC; James C. Eaves, Jr.; Alexander P. Brackett

(57) ABSTRACT

The present invention is a system and method of precisely locating a football on a football field in order to determine whether a first down has been achieved. The invention employs an optical distance measuring device that communicates via a wireless transceiver with a portable display device controlled by an on-field official. The portable display device is equipped with an operator interface used to request measurements of the ball location and is suitably programmed to calculate whether a first down has been achieved based on first and second ball location data points.

8 Claims, 4 Drawing Sheets

Baseline @ 50yd line

METHOD AND APPARATUS FOR LOCATING A FOOTBALL ON A FIELD OF PLAY

CROSS-REFERENCE TO RELATED APPLICATIONS

This application claims the benefit of copending U.S. provisional application No. 60/259,688 entitled "Optical/Electronic Method to Determine an Accurate Distance Used in a Sports Related Environment", filed Jan. 5, 2001.

BACKGROUND OF THE INVENTION

The spotting and positioning of a football on the field of play during a game is undertaken by a plurality of official personnel and often requires the exercise of considerable judgment and approximation. Typically, a pair of chainmen positioned on the sidelines of a football field each hold a pole or "marker" that is connected to the other marker at its bottom by a 30 foot (10 yard) chain, that being the length required for a first down in the game.

One chainman marks the spot of the ball (on the sidelines) where the offensive team begins on first down and the second chainman extends the chain its full length down the sideline and holds the second pole upright to signal to the offensive team the point to which they must advance the ball to achieve a new set of downs (a first down).

Often, a third chainman is utilized to hold upright a ball marker that is indicative of the position of the ball at the initiation of each successive down. This official relies on a line of sight view to the ball position on the field to judge where to place the marker pole on the sideline.

One difficulty with the present system of first down measurement arises when the offensive team advances the ball to a position on the field that is so close to being exactly ten yards from the initial spot of the ball on first down that the officials cannot determine whether a first down has been achieved by simply looking at the sideline markers. In such a case, the chainmen, with the assistance of the on-the-field officials, bring the chain and markers on to the field of play to make an accurate first down determination. Thusly has football become known as a "game of inches".

However, in modern times using chains to make first down measurements unnecessarily slows the pace of the game while the chain officials run on and off the field. This disadvantage is particularly acute at the collegiate and professional levels where games are often televised and broadcast time is at a premium. Furthermore, the chain and marker measurement method requires officials to make judgments on the spot of the ball and is susceptible to human error.

SUMMARY OF THE INVENTION

The instant invention solves the aforementioned problems by providing a system and method of determining the precise location of a football on a playing field for determination of whether a first down has been achieved that utilizes modern opti-electronic equipment to allow the on-the-field officials to quickly and accurately spot and measure ball position.

The invention employs an optical distance measuring device of the type often employed by surveyors to measure the exact location of a football on the field of play. The measurement is taken with respect to a reference point, for example the mid-field line (50 yard line), at which the measuring device may be located. A handheld portable digital display device carried by an on-field official is capable of wireless communication with the optical distance measuring device and is used to initiate a measurement as well as display the results thereof to the official.

A reflector is positioned at the nose of the football to reflect a light pulse emanating from the distance measuring device back thereto. The distance measuring device is equipped with a micro-controller and an operator interface and display and is suitably programmed to calculate the position of the target reflector on the field, either in polar or Cartesian coordinates. The official on the field sets the reflector at the nose of the ball and initiates the measurement using the operator interface.

Given the initial measurement, the official can request the distance measurement device to measure the exact position of the ball at a second location. The distance measurement device thence sends the position data to the portable display whereupon it is converted to suitable Cartesian coordinates, if necessary, and a first down determination is made and displayed on the portable display. This information is then displayed to the on-the-field official. Since there is no need for a chain crew to run on and off the field, the instant invention can measure first down yardage in a few seconds.

Accordingly, it is one object of the instant invention to provide a time-saving method of measuring a first down in the game of football.

It is another object of the instant invention to provide a hand-held device to an on-field official for the initiation of first down measurements.

It is another object of the invention to provide an accurate method of determining whether a first down is made in a game of football.

Other features and advantages of the invention will become apparent after reading the detailed description of the preferred embodiments taken in conjunction with the accompanying drawing figures.

DETAILED DESCRIPTION OF THE PREFERRED EMBODIMENT

Figure 1:
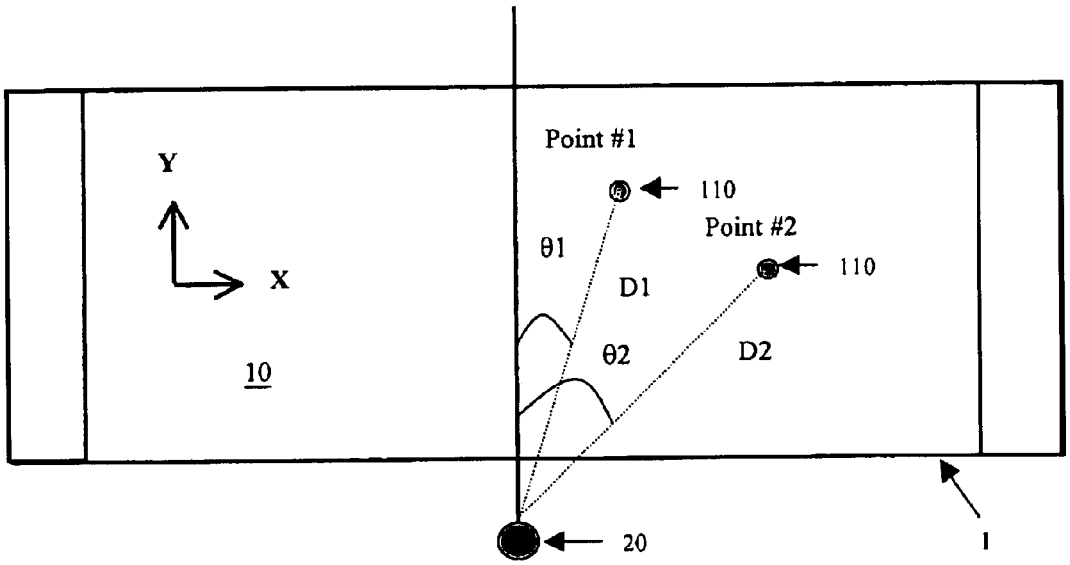
FIG. 1 is a diagram of a football field.
Figure 2:
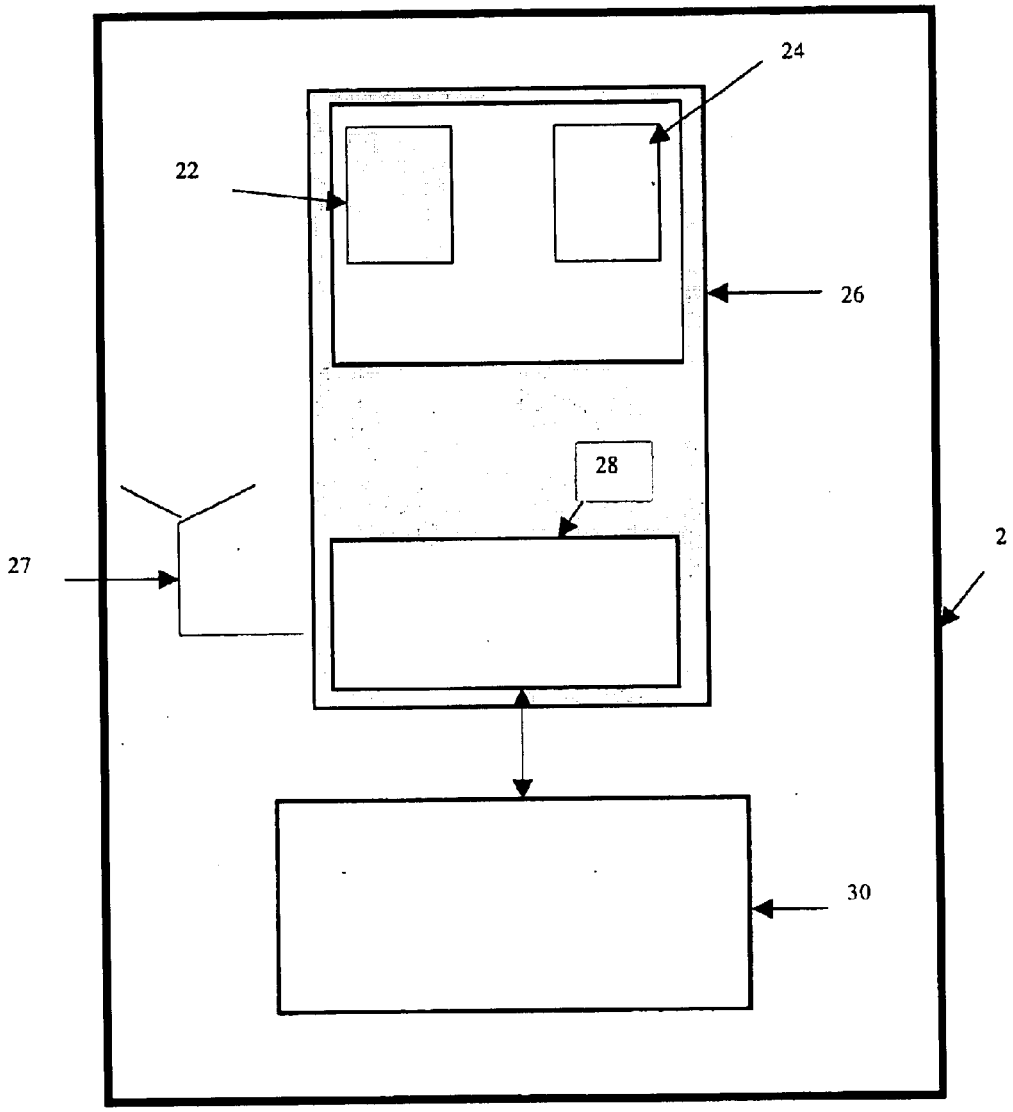
FIG. 2 is a diagram of the distance measuring device in accordance with the instant invention.
Figure 3:
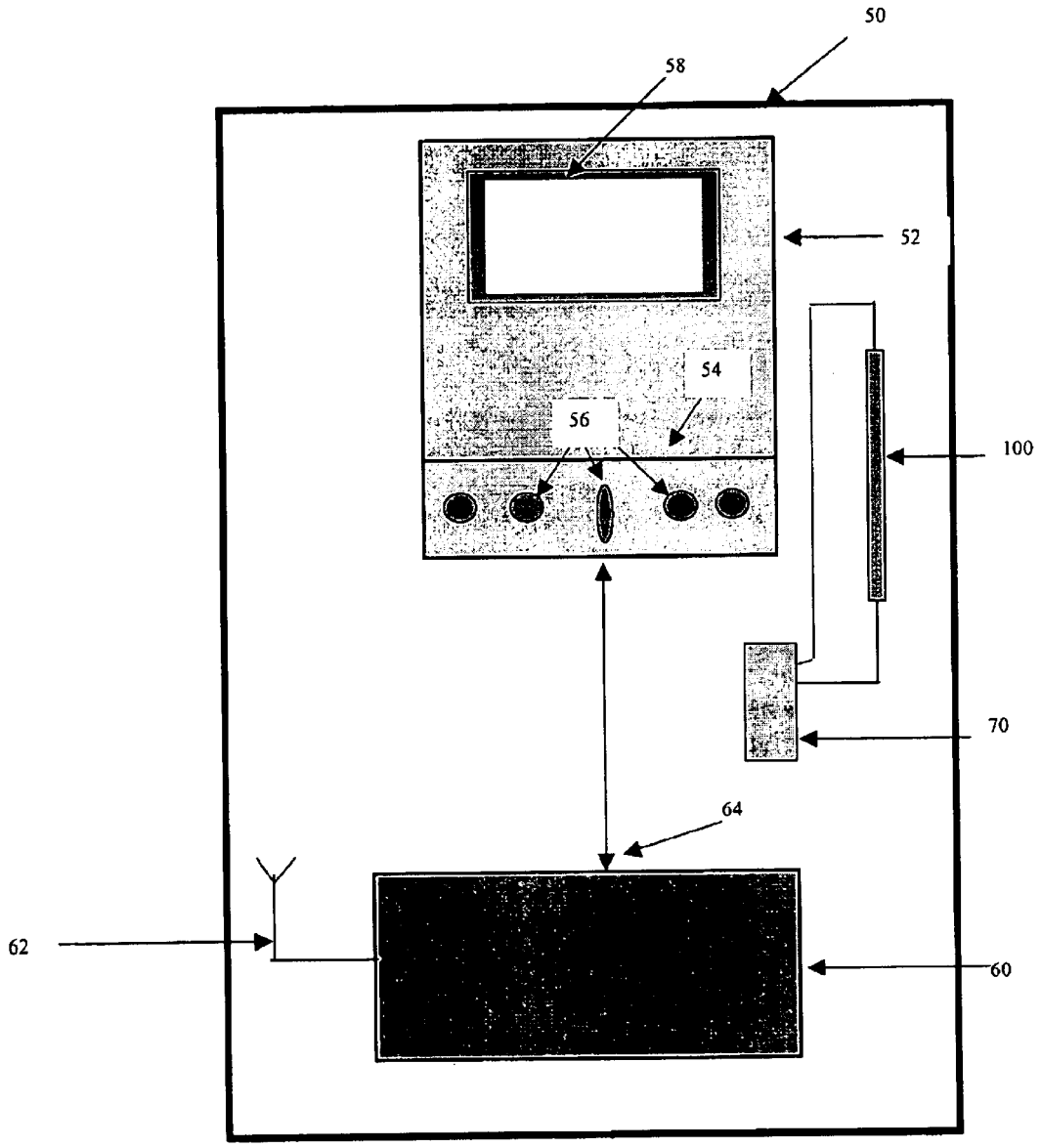
FIG. 3 is a diagram of a portable display device in accordance with the instant invention.

Referring now to FIGS. 1, 2, and 3 and in accordance with a preferred constructed embodiment of the instant invention, a system 10 and method for determining the exact location of a football on a football field 1 and determining whether a first down has been achieved comprises an optical distance measuring device 20 and a corresponding portable digital display device 50 that is small enough to be carried by an official on the field of play in an unobtrusive fashion.

The optical distance measuring device 20 is preferably of the type employing a light generating means, for example a laser, and a concomitant means for detecting the presence of light at that same frequency, for example when the light is reflected back at the measuring device 20. The measuring device 20 may be a conventional laser surveying device, for example a Lieca TPS 1100 produced by Lieca Geosystems of Norcross, Ga., or its equivalent as is well known to one of ordinary skill in the art.

The optical distance measuring device 20 preferably employs a transmitting lens 22 emitting pulses of low-power laser light and a receiving lens 24 capable of detecting that laser light when it is reflected off of a surface. Devices 20 of this type operate on a time-of-flight principle whereby the time required for a pulse to traverse from the generating means back to the receiving means is carefully measured. This time is used to calculate an accurate distance to the reflection point since the velocity of the laser light pulses is a known constant.

Furthermore, the optical measuring device 20 employed in the present invention is capable of rotational motion in at least one plane such that an angle to a given distance target may be measured, given a baseline "zero" angle. The angle and distance are simply the precise location of the object being measured in a polar coordinate system. Many known-in-the art optical distance measuring systems are mounted on motorized carriages, that are capable of rotational motion in at least one plane, thereby facilitating the measurement of the angle to the target from a baseline angle. The optical distance measuring device 20 is equipped with a transceiver 26 capable of transmitting and receiving radio frequency signals through an antenna 27 for communication with the portable digital display device 50, as will be described in greater detail herein below. The distance measuring device is further equipped with a computer means 28 and associated memory 30 to perform the necessary distance calculations, as is well known to one of ordinary skill in the art.

As best shown in FIG. 3, the portable digital display device 50 comprises a digital display 52 having a micro-controller 54 and associated system memory 56, and an operator interface 58, for example a touch screen. The aforementioned elements of the portable display device 50, namely the display 52, micro-controller 54, memory 56, and operator interface 58 may comprise a personal digital assistant device, for example a PALM™ or a BlackBerryT™ as is well known to one of ordinary skill in the art.

The display device 50 further comprises a transceiver 60 having an antenna 62 and a communications port 64 for transmitting data to and from the micro-controller 54. The transceiver 60 is capable of sending and receiving radio frequency data to and from the transceiver 22 of the optical distance measuring device 20. In a preferred constructed embodiment of the instant invention a Cirronet™ 2410 wireless modem is employed as a transceiver 60 in the portable display device 50.

Figure 4:
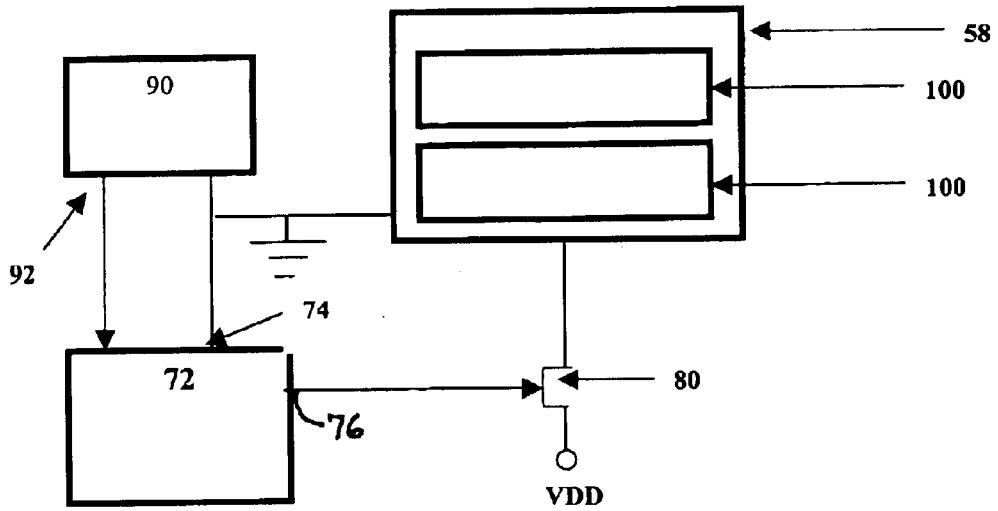
FIG. 4 is a block diagram of a heater control in accordance with an embodiment of the invention.

In an alternative embodiment of the instant invention as shown in FIG. 4, the display device 50 further employs a temperature control 70 comprising a micro-controller 72, having an input 74 for accepting an electrical signal representative of temperature and an output 76 electrically connected to a transistor switching device 80, for example a MOSFET switch known to one of ordinary skill in the art.

The temperature control 70 further comprises a temperature sensor 90, for example a resistive thermocouple device or the equivalent, having an output 92 electrically connected to the input 74 of the micro-controller 70. A plurality of thin film heater elements 100 disposed proximate the operator interface 58 of the portable display 50 are connected to a dc power source through the switch 80.

The micro-controller 72 is suitably programmed to supply a pulse width modulated signal at the output 76 when the temperature as measured by the temperature sensor 90 falls below a predetermined set-point. By increasing the duty cycle of the pulse-width modulated signal supplied to the switch 80, the rate of temperature increase may be controlled by the micro-controller 72. Once a predetermined high temperature set-point as measured by the sensor 90 is reached, the output 76 is simply switched off by the micro-controller. The temperature control 70 of the instant invention operates to prevent the "freezing up" of the operator interface 58 to allow cold-weather operation of the portable display device 50.

In operation, the instant invention can determine the location of a target object—in this case a football—as well as determine whether an offensive team has advanced the ball to attain a new set of downs, given its initial location. As best seen in FIG. 1, the instant invention uses the convention that the 'x' direction in a Cartesian coordinate system represents the advance (or retreat) of the ball on the football field, although any coordinate system may be used for distance calculation.

The distance measurement device 20 is placed at a point on the sideline of the football field even with the mid-field line (50 yard line). In an exemplary embodiment of the instant invention the 50 yard line is used as a baseline for the distance measuring device, but any known location relative to the playing field 1 may be employed in practice. In one embodiment of the instant invention, the distance measuring device is positioned along the mid-field line at a point elevated above the field of play 1, in order to maximize the ability to obtain an unobstructed line of sight to a movable light reflector 110, for example a reflecting prism. The mid-field line is convenient to use as a baseline for the distance measuring device 20 since the maximum x-axis distance from the measuring device 20 is fifty yards.

To initiate the measurement of a football on the field of play 1, an on-the-field official places a reflector 110, for example a prism, proximate the nose of the ball. The reflector may be mounted on a post or stake that is readily inserted into the field 1 at the nose of the football in order to facilitate the use thereof. Once the reflector is positioned the official uses the portable display device 50 to send a "reset measurement data" command to the distance measurement device 20 by selecting a "reset" button on the operator interface 58. The "reset measurement device" command is used to obtain the position of a football on the field at an initial location, for example when a first down has been achieved that does not require a measurement to determine. The reset measurement data command is then sent by the transceiver 60 to the distance measurement device 20. The transceiver 26 of the distance measurement device 20 receives the request from the portable display device 50 and activates its transmitting lens, first to "search" for the reflector target, then to obtain the requested distance measurement and angle, as previously described.

Once the position data for the initial location is obtained, the distance measurement device 20 sends the new data back to the portable display device 50, where it is stored in memory 57 for further use. When the official desires to take a first down measurement, once again the reflector is placed proximate the nose of the football while the football is resting in a second location, and the official uses the portable display 50 to send a "get measurement" request to the distance measurement device 20, again by selecting a button or icon via the operator interface 58. The distance measurement device then calculates the distance and angle to the reflector (at the nose of the ball) as detailed hereinabove. Once obtained, the distance measurement device 20 sends the location data for the ball at its second location to the portable digital display 50.

In one embodiment of the instant invention, the above-referenced method is accomplished by simply reflecting the light pulse from the distance measuring device 20 from the nose of the football (or other target) itself. Additionally, the football may have a small quantity of reflective material on the nose thereof, to aid in reflection of the light pulse.

Once the raw data for ball position at an initial and a second location has been stored in the memory 56 of the portable display device 50, the device can quickly calculate the difference in the two locations in the direction of the x-axis by simply converting the data points from polar to Cartesian coordinates and taking the absolute value of the difference between the points on the x-axis. Referring again to FIG. 1, wherein P1 and P2 represent two discrete ball locations D1 and D2 two distances, and ø1 and ø2 two angles to the respective points, the difference in distance along the x-axis between the two points is readily calculated according to the following formula:

$$\Delta X=|D2 \sin \varnothing 2-D1 \sin \varnothing 1|$$

When $\Delta x>10$ yards, a first down has been achieved, and a message to the official on the operator interface 58 indicates this fact. The raw data from the second location is then stored for use as an initial location for the next set of downs. While the instant invention employs suitable programming in the portable display device 50 to perform the calculations referred to above, one of ordinary skill will recognize that a wide variety of calculation techniques may be employed in the instant invention, for example, the writing of simple macros.

In another embodiment of the instant invention, the distance measurement device 20 computer 28 converts the data from polar to Cartesian coordinates prior to transmitting the data to the portable display device 50. The portable display device 50 is then programmed only to calculate the absolute value of the difference of the x-coordinates to determine whether a first down was made.

In another embodiment of the instant invention, the portable display device 50 transceiver 58 is adapted to transmit a "first down" message and the location of the ball on the field 1 to a remote display station (not shown), for example a scoreboard visible to the public, that is equipped with a receiver or transceiver for receiving wireless signals. This feature of the instant invention facilitates the dissemination of first down and/or ball position information nearly instantaneously to those in attendance at the football game. Additionally, the data recorded by the portable display device may be readily transmitted to any electronic device having a transceiver for the dissemination of on-field information in real time. For example, a conventional computer used to compile game statistics can be equipped with a transceiver 60 to receive and record data transmitted from a one of the portable display devices 50.

In one embodiment of the invention, a plurality of portable display devices 50 may be employed to inform other on-field personnel, for example officials and coaches, of the measurement data (or any other data) being transmitted. This feature allows coaches and other officials access to first down measurement information as soon as it is known.

In an alternative embodiment of the instant invention, a plurality of distance measuring devices 20 may be positioned at a plurality of locations around the field 1 thereby obviating the need to have a clear line of sight to the target being measured from any one measuring device 20. In this embodiment, the distance measuring devices 20 may be positioned such that their baseline (0 angle) is parallel to a known yard line on the field 1 and thus perpendicular to the sideline thereof. When one distance measuring device is "blocked" by players on the field 1 data points from any one of the other distance measuring devices 20 may be used to calculate the position of the football on the field using the aforementioned method.

Furthermore, each of the plurality of distance measuring devices 20 can 'adjust' for not being located on the same baselines by simply subtracting the difference between the baseline of each distance measuring device 20 taking a distance measurement and a master baseline, for example the mid-field line, a goal line, or an end-zone line.

Additionally, each of the plurality of distance measurement devices 20 can "locate" themselves with respect to the sideline of the football field 1 by simply distancing two known points on the field of play. As an example a distance measuring device 20 can find the distance and angle from its present location to the corner of one goal line and the side line, and also the distance and angle from its present location to the corner of the opposite goal line and the side line that is exactly one hundred yards distant.

This measurement of two known points provides one interior angle and the length of the three sides of a triangle defined by the distance measuring device 20 and the two goal line corners. Given this information, one can readily calculate the point on the sideline at which the distance measuring device's 20 line of sight is directly perpendicular thereto, in other words it's baseline, by application of simple trigonometry and geometry. Using this technique, the distance measuring devices 20 may be situated at any point relative to the field to practice the instant invention.

The foregoing detailed description is given primarily for clearness of understanding and purposes of illustration. No unnecessary limitations to the instant invention and the alternative embodiments thereof are to be understood therefrom, for modifications can be made by those of ordinary skill in the art upon reading this disclosure without departing from the scope of the invention.

We claim:

1. A method of locating a football on afield of play and determining whether a first down has been achieved pursuant to the rules of the game comprising the steps of:

providing at least one portable display device having a micro-controller and an associated system memory, a transceiver for sending and receiving wireless data and an operator interface;

providing at least one distance measuring device having a means for sending and receiving light pulses, a transceiver capable of wireless communication with said digital display device and an operator interface, said distance measuring device disposed at a known location relative to said field of play;

placing a reflector proximate the nose of said football when said football is resting at an initial location to reflect a light beam from said measuring device back thereto;

calculating a first position of said football at the initial location on said field of play relative to a mid-field line using said distance measuring device;

placing a reflector proximate the nose of said football when said football is resting at a second location to reflect a light beam from said measuring device back thereto;

calculating a second position of said football at the second location on said field of play relative to the mid-field line using said distance measuring device;

determining whether a first down has been achieved by comparing the first and second calculated positions of said football; and displaying whether a first down has been achieved on said portable display device.

2. A method of locating a football on a field of play and determining whether a first down has been achieved pursuant to the rules of the game as claimed in claim 1 wherein the steps of calculating first and second positions of said football further comprise;

calculating a distance from the reflector proximate the football to the distance measuring device;

measuring the angle between the mid-field line and a line drawn between the distance measuring device and the reflector wherein said distance and angle represent the position of the nose of said football in polar coordinates relative to the position of said distance measuring device; and transmitting the distance and angle of the first and second positions of said football to said portable display device.

3. A method of locating a football on a field of play and determining whether a first down has been achieved pursuant to the rules of the game as claimed in claim 2 wherein the step of determining whether a first down has been achieved comprises:

converting the distance and angle of the first and second positions of said football into corresponding Cartesian coordinates wherein the x-axis represents the distance towards or away from a goal line from the mid-field line; and calculating the absolute value of the difference between the x-coordinates of the first and second positions of said football wherein an absolute value greater than or equal to ten yards represents a first down.

4. A method of locating a football on a field of play and determining whether a first down has been achieved pursuant to the rules of the game as claimed in claim 1 comprising the further step of:

transmitting whether a first down has been achieved to a scoreboard device for display.

5. A method of locating a football on a field of play and determining whether a first down has been achieved pursuant to the rules of the game as claimed in claim 1 further comprising the step of:

storing the first and second positions of said football in said portable display device memory; and replacing the first position of said football with the second position of said football in memory when a first down is achieved.

6. An apparatus to locate a football on a field of play and determine whether a first down has been achieved according to the rules of the game comprising:

a portable display device having an operator interface for initiating a measurement and reviewing the results thereof and having a transceiver for sending and receiving data;

a distance measuring device having a means for generating a light pulse, a means for detecting the light pulse when reflected, a means for measuring the time elapsed between sending a light pulse and detecting the reflected light pulse, a computer means for calculating the position of a target relative to said distance measuring device, and a transceiver for sending and receiving data capable of communication with said portable display device; and a reflector to place proximate the nose of a football for reflecting the light pulse back to said distance measuring device.

7. An apparatus as claimed in claim 6 wherein said portable digital display device further comprises:

a heater control circuit for maintaining a desired temperature for said portable display device comprising a temperature sensor having an output representative of temperature connected to an input of a micro-controller, said micro-controller having a pulse-width modulated output electrically connected to a transistor switch, and a plurality of transparent thin film heater elements electrically connected to a power source through said transistor switch, wherein said micro-controller varies the pulse-width modulated output to maintain a temperature sufficient to allow operation of said display device during cold-weather.

8. A method of locating a football on a field of play and determining whether a first down has been achieved pursuant to the rules of the game comprising the steps of:

providing at least one portable display device having a micro-controller and an associated system memory, a transceiver for sending and receiving wireless data and an operator interface;

providing at least one distance measuring device having a means for sending and receiving light pulses, a transceiver capable of wireless communication with said digital display device and an operator interface, said distance measuring device disposed at a known location relative to said field of play;

reflecting a light beam from said measuring device to said football and back when said football is in a first position for measuring the distance from said measuring device to said football;

calculating a first position of said football at the initial location on said field of play relative to a mid-field line using said distance measuring device;

reflecting a light beam from said measuring device to said football and back when said football is in a second position for measuring the distance from said measuring device to said football;

calculating a second position of said football at the second location on said field of play relative to the mid-field line using said distance measuring device;

determining whether a first down has been achieved by comparing the first and second calculated positions of said football; and displaying whether a first down has been achieved on said portable display device.

* * * * *